US009899760B2

(12) United States Patent
Kleymann et al.

(10) Patent No.: US 9,899,760 B2
(45) Date of Patent: Feb. 20, 2018

(54) ELECTRICAL CONNECTOR HAVING A METALLIC FERRULE ACCOMMODATED WITHIN A RECEPTACLE AND CRIMPED TO A CABLE

(71) Applicant: Yazaki Europe Ltd., Hertfordshire (GB)

(72) Inventors: Ulrich Kleymann, Hemer (DE); Darko Hlusicka, Zagreb (HR); Ante Camber, Zagreb (HR); Matija Radeljic, Zagreb (HR)

(73) Assignee: YAZAKI EUROPE LTD., Hertfordshire (GB)

( * ) Notice: Subject to any disclaimer, the term of this patent is extended or adjusted under 35 U.S.C. 154(b) by 0 days.

(21) Appl. No.: 15/416,652

(22) Filed: Jan. 26, 2017

(65) Prior Publication Data

US 2017/0222349 A1 Aug. 3, 2017

(30) Foreign Application Priority Data

Feb. 2, 2016 (EP) ..... 16153899

(51) Int. Cl.

| | |
|---|---|
| ***H01R 13/58*** | (2006.01) |
| ***H01R 13/64*** | (2006.01) |
| ***H01R 13/436*** | (2006.01) |
| ***H01R 9/03*** | (2006.01) |
| *H01R 13/506* | (2006.01) |
| *H01R 107/00* | (2006.01) |

(52) U.S. Cl.

CPC ..... *H01R 13/4361* (2013.01); *H01R 9/03* (2013.01); *H01R 13/5808* (2013.01); *H01R 13/5837* (2013.01); *H01R 13/64* (2013.01); *H01R 13/506* (2013.01); *H01R 2107/00* (2013.01)

(58) Field of Classification Search

CPC .. H01R 13/64; H01R 13/518; H01R 13/5837; H01R 13/6271; H01R 13/6275; H01R 13/6582; H01R 13/58

USPC ..... 439/352, 353, 355, 455, 677, 680

See application file for complete search history.

(56) References Cited

U.S. PATENT DOCUMENTS

| | | | | |
|---|---|---|---|---|
| 3,315,392 A * | 4/1967 | Edwards | G09F 7/08 24/DIG. 17 |
| 4,310,213 A | 1/1982 | Fetterolf, Sr. et al. | |
| 4,634,208 A * | 1/1987 | Hall | H01R 9/032 439/607.51 |
| 6,257,920 B1 | 7/2001 | Finona et al. | |
| 7,101,223 B2 * | 9/2006 | Neumann | H01R 13/5808 439/585 |

(Continued)

FOREIGN PATENT DOCUMENTS

| | | |
|---|---|---|
| EP | 1 540 771 A1 | 6/2005 |
| WO | 97/007566 A1 | 2/1997 |

*Primary Examiner* — Chandrika Prasad

(74) *Attorney, Agent, or Firm* — Sughrue Mion, PLLC

(57) ABSTRACT

An electrical connector including: a terminal body; an insulator accommodated within a receptacle of the terminal body, the insulator having at least one cavity adapted for holding a terminal connected to a wire of a cable; a metal ferrule accommodated within the receptacle of the terminal body; wherein the metal ferrule has a crimp portion adapted to be crimped onto the cable; wherein the metal ferrule is form-fittingly connected to the terminal body; and wherein the metal ferrule has a sleeve like holding portion centering the ferrule within the receptacle.

15 Claims, 6 Drawing Sheets

(56) References Cited

U.S. PATENT DOCUMENTS

| | | | | |
|---|---|---|---|---|
| 2005/0221670 | A1* | 10/2005 | Neumann | H01R 13/5808 439/585 |
| 2009/0224928 | A1* | 9/2009 | Kopp | G01F 23/28 340/614 |
| 2009/0233483 | A1* | 9/2009 | Huixiong | H01R 9/0518 439/585 |
| 2011/0244713 | A1 | 10/2011 | Ihde et al. | |
| 2014/0044397 | A1* | 2/2014 | Hikosaka | G02B 6/38 385/81 |

* cited by examiner

ELECTRICAL CONNECTOR HAVING A METALLIC FERRULE ACCOMMODATED WITHIN A RECEPTACLE AND CRIMPED TO A CABLE

BACKGROUND OF THE INVENTION

Field of the Invention

The present disclosure relates to an electrical connector comprising a terminal body, an insulator accommodated within a receptacle of the terminal body, said insulator having at least one cavity adapted for holding a terminal connected to a wire of a cable, and a metal ferrule accommodated within said receptacle of said terminal body. The metal ferrule has a crimp portion adapted to be crimped onto said cable.

Background

An electrical connector of this kind is disclosed in U.S. Pat. No. 4,310,213 A.

Another electrical connector is disclosed in EP 1 540 771 B1. The disclosed connector has a terminal body in the form of an outer shell accommodating an insulator made of a dielectric material. The connector further comprises a ferrule in the form of a sleeve. The ferrule is placed onto the outer insulation of a cable. An outer braid of the cable, which serves as a shielding of the cable, is folded back onto an outer circumferential face of the ferrule. The ferrule is then inserted into a receptacle of the terminal body. As the terminal body is made of an electro-conductive material the terminal body is electrically connected to the shielding of the cable. The ferrule is press-fit into the terminal body and also serves to hold the insulator in place within the terminal body. The insulator accommodates a plurality of terminals which are electrically connected to wires of the cable.

A further connector of that kind is disclosed in EP 1 905 131 B1.

Such connectors are typically used for high-speed data connection systems which require a high data speed transmission and which are reliability. At high signal speeds, the signal degrades due to cross-talk interference between parallel orientated conductors. Therefore, twisted pair cables are widely used and further improved by a shielding of the cable and the connector. However, there is also an increasing need for low cost high-speed data connections without shielding.

SUMMARY OF THE INVENTION

In one form, the present disclosure provides an electrical connector comprising a terminal body, an insulator accommodated within a receptacle of the terminal body, said insulator having at least one cavity adapted for holding a terminal connected to a wire of a cable, and a metal ferrule accommodated within said receptacle of said terminal body. The metal ferrule has a crimp portion adapted to be crimped onto said cable. The metal ferrule is form-fittingly connected to said terminal body and has a sleeve like holding portion centering the ferrule within the receptacle.

The ferrule is made of metal and has a crimp portion adapted to be crimped onto said cable. In addition, the metal ferrule is form-fittingly connected to the terminal body.

The ferrule is made of metal in order to enable the ferrule to be crimped onto the outer insulation of the cable. Crimping the ferrule onto the cable makes sure that the ferrule is safely fixed to the cable and provides a high resistance against axial movement along the cable. Since the metal ferrule is further form-fittingly connected to the terminal body it provides a high pull-out force resistance.

Another aspect of the disclosure is that the same ferrule having one standardized size can be used for different outer diameters since the crimp portion is crimped and pressed onto the outer diameter of the cable and is adapted to the dimension of the cable by the crimping process. Hence, the terminal body, the insulator and the metal ferrule do not have to be adapted to different cable diameters. The same terminal body, insulator and metal ferrule can be used for different cable diameters.

The electrical connector can be used for shielded cables and for unshielded cables. If a shielded cable is used, the shielding of the cable has to be electrically connected to the metal ferrule which further is in electrical contact to the terminal body. In this embodiment the terminal body has to be made of a conductive material. Alternatively, the electrical connector can also be used for an unshielded cable. In this case the terminal body can be made of plastic material in order to reduce costs.

Preferably, the terminal body has substantially the form of a tube forming the receptacle. The ferrule is inserted into the tube like terminal body wherein the ferrule has a sleeve like holding portions centering the ferrule within the receptacle. The holding portion has an outer diameter which is adapted to the inner diameter of the portion of the receptacle which accommodates the holding portion so that the ferrule is centered without or with a very small radial play. The crimping portion is independent from the holding portion so that the crimping of the crimping portion does not influence the outer diameter of the holding portion. Therefore, as described above, the crimping portion can be adapted to different cable diameters without influencing the fit of the holding portion within the receptacle of the terminal body.

Preferably, the holding portion of the ferrule is formed by wall portions which are bent into the form of a sleeve. The ferrule is preferably made of sheet metal bent into a substantial sleeve like form forming the holding portion as described before and the crimp portion.

The holding portion and the crimp portion can be arranged consecutively in axial direction.

In order to make sure, that the ferrule is mounted into the terminal body in a specific angular orientation around the longitudinal axis of the terminal body, the holding portion can be provided with a polarization rib projecting in a radial direction outwardly. The terminal body is then provided with a slot extending parallel to the longitudinal axis and in which the polarization rib can be inserted, when inserting the ferrule into the terminal body.

For a person skilled in the art it is understood that the polarization means can be arranged vice versa. This means that the ferrule can be provided with a slot extending parallel to the longitudinal axis and the terminal body can be provided with a polarization rib extending into the slot of the ferrule.

The receptacle of the terminal body has two portions, i.e. a forward portion and a rearward portion. The insulator is accommodated in the forward portion and the ferrule is accommodated in a rearward portion. In a mating direction of the electrical connector with a counter-connector the forward portion is arranged in a forward part of the terminal body and the rearward portion in the rearward part of the terminal body. Therefore, when mating the electrical connector with a counter-connector the insulator, which is adapted to accommodate electrical terminals, can be mated with an insulator with terminals of the counter-connector. The ferrule is, viewed in mating direction, behind the insulator.

The insulator and the ferrule are inserted into the receptacle in an insertion direction parallel to the longitudinal axis of the terminal body. Preferably, the insertion direction is identical to the mating direction of the electrical connector.

In insertion direction, the ferrule is axially supported against a first stop face arranged in the rearward portion of the receptacle. The first stop face ensures that during the insertion of the ferrule into the receptacle the ferrule can only be pushed until it reaches the first stop face.

In addition, in insertion direction, the insulator can be axially supported against a second stop face arranged in the forward portion of the receptacle. The second stop face ensures that the insulator is not pushed too far into the receptacle of the terminal body when mounting it and inserting it into the terminal body.

Both stop faces, i.e. the first stop face and the second stop face, ensure that the ferrule and the insulator cannot be pushed too far into the terminal in insertion direction.

In order to ensure that the ferrule cannot be pulled out of the receptacle after the insertion the ferrule is form-fittingly held also in a direction opposite to the insertion direction. The ferrule can be provided with a locking projection supporting the ferrule against the terminal body in a direction opposite to the insertion direction. The locking projection projects from an outer circumferential surface of the ferrule in a radial direction. The locking projection projects into a locking opening of the terminal body and is supported against a holding face formed by said opening. For a person skilled in the art it is understood that this can be provided vice versa. The terminal body can be provided with a locking projection projecting radially inwardly towards the longitudinal axis and which projects into a locking opening of the ferrule.

By inserting the ferrule into the terminal body the locking projection is deflected radially inwardly until it reaches the opening and the locking projection can move back into an undeflected position latching behind the locking face of the opening. The locking projection is, preferably, cut-out of the sheet metal material.

Comparable to the support of the ferrule in a direction opposite to the insertion direction the insulator can also be held in a direction opposite to the insertion direction. For this reason the terminal body may be provided with at least one locking arm supporting the insulator against pull-out forces in the direction opposite to the insertion direction. The locking arm projects radially inwardly from the terminal body and is axially supported against a locking face of the insulator. By inserting the insulator into the terminal body the locking arm is deflected radially outwardly until the locking arm latches behind the locking face of the insulator.

For a person skilled in the art it is understood that alternatively the terminal body can be provided with a locking arm latching behind a locking face of the terminal body.

The crimp portion is preferably provided with crimp wings which are wound around the cable and overlap each other. The crimp wings can overlap in a radial direction. Alternatively, the crimp wings can be offset viewed in an axial direction so that they overlap in an axial direction. Both solutions provide that the crimping wings can be crimped to a different extend so that the crimp connection can be adapted to different outer diameters of the cable.

BRIEF DESCRIPTION OF THE DRAWINGS

Other objections and advantages will become apparent from the following detailed description referring to the accompanying drawings, wherein.

DETAILED DESCRIPTION OF THE INVENTION

Figure 1:
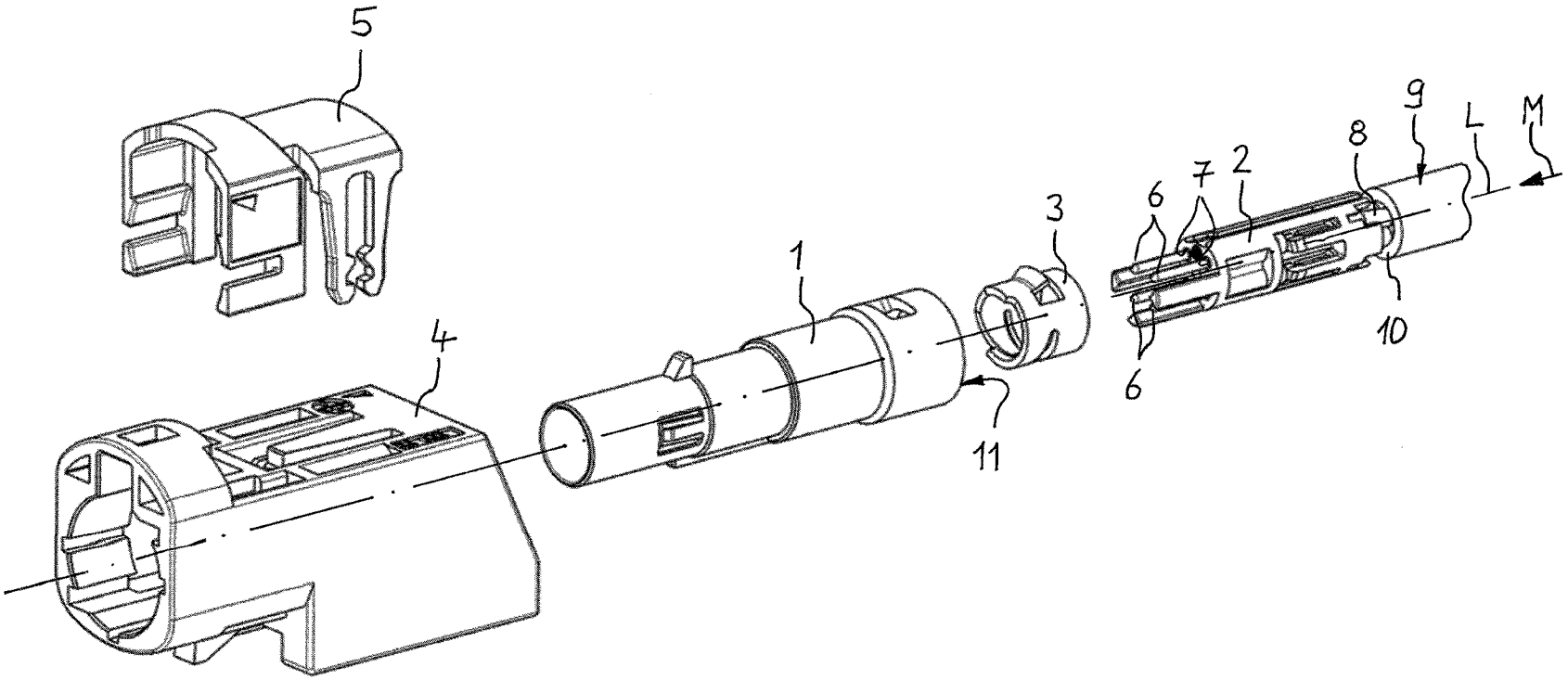
FIG. 1 is an exploded view of a first embodiment of an electrical connector.
Figure 2:
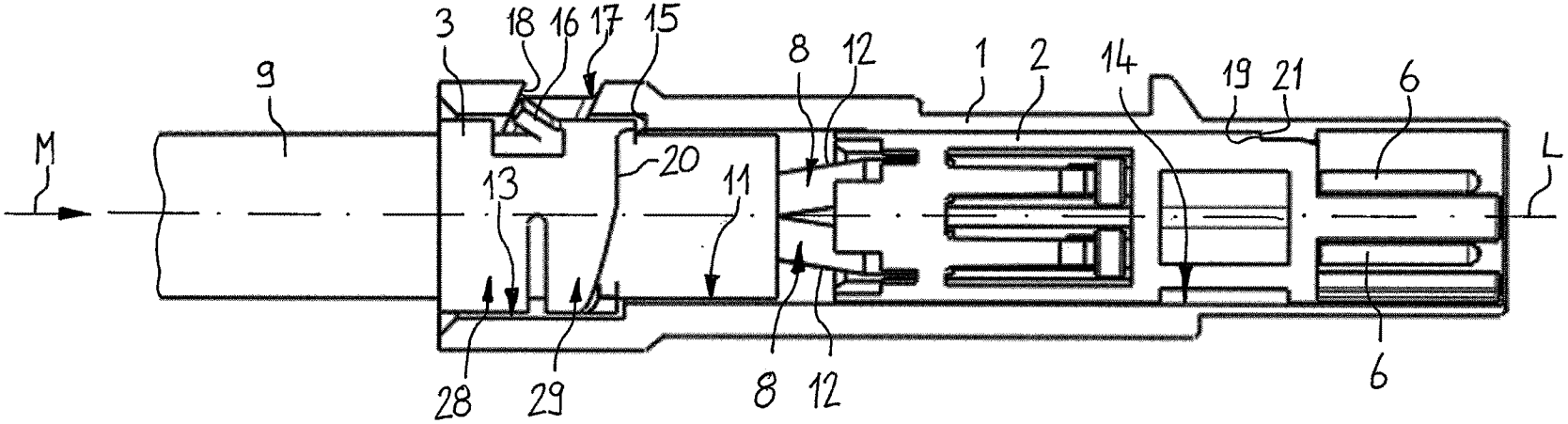
FIG. 2 is a first longitudinal sectional view of the electrical connector according to FIG. 1.
Figure 3:
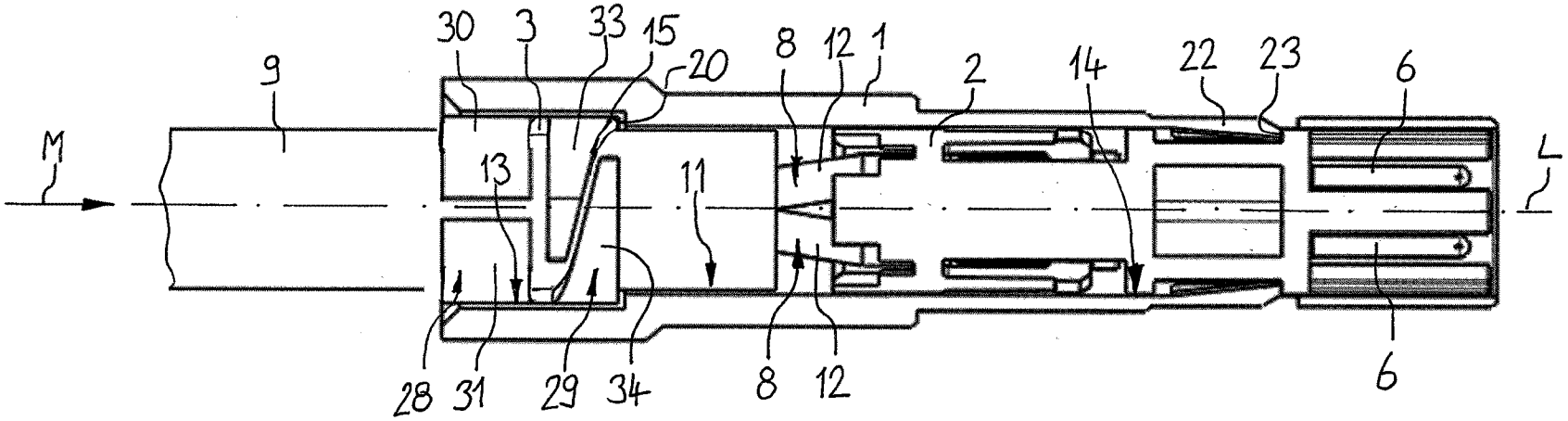
FIG. 3 is another longitudinal sectional view of the electrical connector according to FIG. 1.
Figure 4:
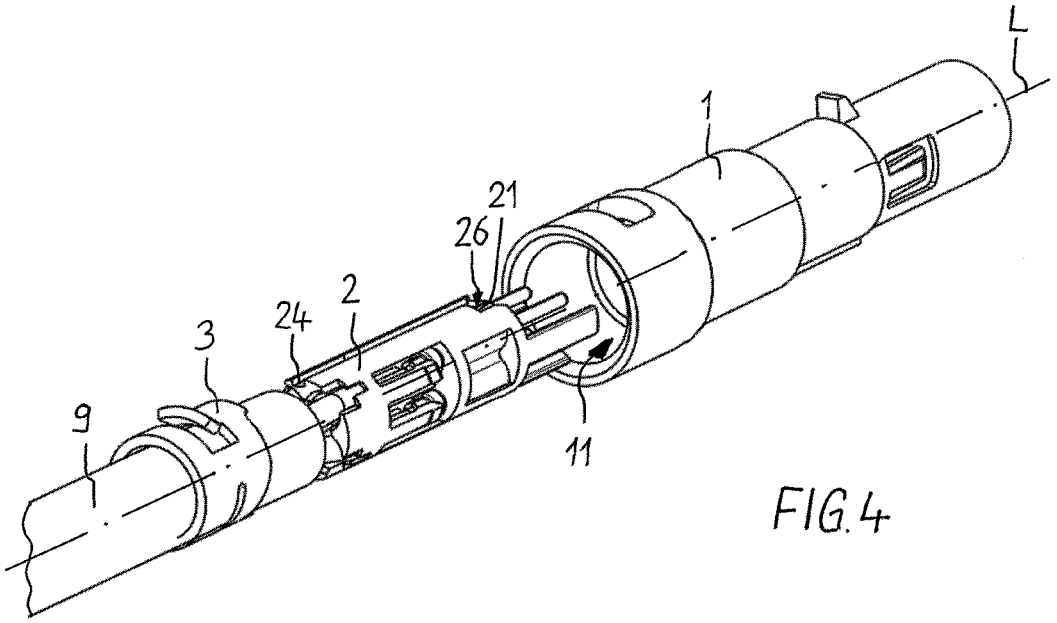
FIG. 4 is a perspective view of the electrical connector according to FIG. 1.

FIGS. 1 to 5 depict a first embodiment of an electrical connector in different views and are described together.

The electrical connector comprises a terminal body 1 in the form of a tube, an insulator 2 and a metal ferrule 3. The tube like terminal body 1 accommodates the insulator 2 which is inserted into the terminal body 1 in an insertion direction M which is identical to a mating direction of the electrical connector for mating same with a counter connector. The insertion direction M is orientated parallel to a longitudinal axis L defined by the terminal body 1.

The electrical connector is part of a connector assembly which further comprises a connector housing 4 having a TPA (Terminal Position Assurance) device 5 mounted onto the connector housing 4. The terminal body 1 is inserted into the connector housing 4 which can be connected to a connector housing of a counter connector assembly.

The insulator 2 has a plurality of cavities 7 which are in the form of through openings in the insulator 2 and each of which accommodates one male terminal 6. In the present embodiment the electrical connector has four male terminals 6, each of which is connected to a wire 8 of a cable 9. For persons skilled in the art it is understood that also other cables having a different number of wires can be used wherein the number of male terminals 6 is adapted to the number of wires 8.

The cable 9 has an insulation 10 covering the wires 8. The ferrule 3 is placed and mounted, as described herein after, onto the insulation 10 of the cable 9. Each of the wires 8 is also provided with an insulation 12 covering a conductor, latter being connected to the respective male terminal 6.

The receptacle 11 has a rearward portion 13 and a forward portion 14 wherein viewed in insertion direction M the forward portion 14 is arranged in front of the rearward portion 13. Both portions 13, 14 of the receptacle 11 are substantially circular wherein the rearward portion 13 has a greater diameter than the forward portion 14. The insulator 2 is arranged within the forward portion 14 and the ferrule 3 is arranged in the rearward portion 13. The sub-assembly of cable 9, insulator 2 and ferrule 3 is inserted in insertion direction M into the receptacle 11. The Insulator 2 is pushed into the receptacle 11 until the ferrule 3 abuts a first stop face 15 within the rearward portion 13 of a receptacle 11. The ferrule 3 has a first front face 20 which is supported against said first stop face 15. The first stop face 15 is formed by a step between the rearward portion 13 having a greater diameter and the forward portion 14 having a smaller diameter.

The insulation 10 of the cable 9 reaches into the forward portion 14 of the receptacle 11. The insulator 2 in front of the insulation 10 of the cable 9 is inserted into the forward portion 14 of the receptacle 11 until a second front face 21 of the insulator 2 abuts a second stop face 19 of the terminal body 1. In order to ensure that the male terminals 6 are correctly orientated in regard to the angular position around the longitudinal axis L the insulator 2 and the terminal body 1 have a polarization feature. The insulator 2 has a guiding slot 24 orientated parallel to the longitudinal axis L which is formed into an outer circumferential face of the insulator 2 and has an enlarged portion 26. The enlarged portion 26 has a greater extension in circumferential direction than the rest of the guiding slot 24. Between the enlarged portion 26 and the rest of the guiding slot 24 the second front face 21 is formed, as can best be seen in FIG. 4.

Figure 5:
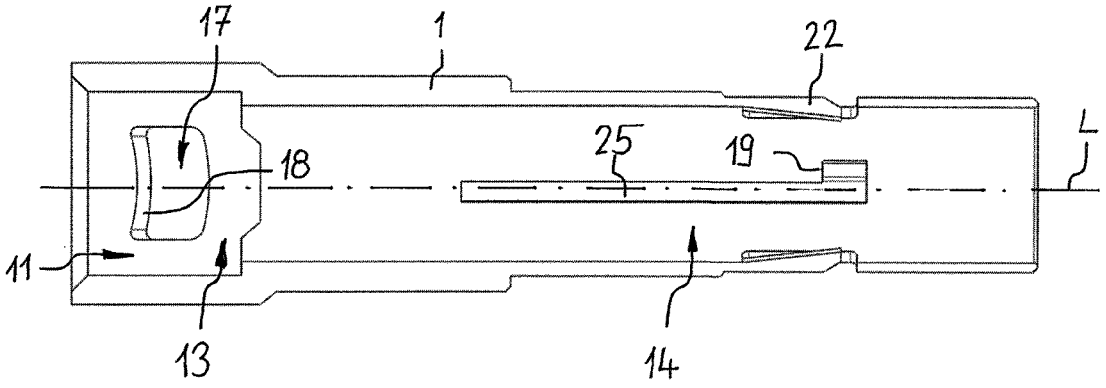
FIG. 5 is a longitudinal sectional view of the terminal body of the electrical connector according to FIG. 1.
Figure 6:
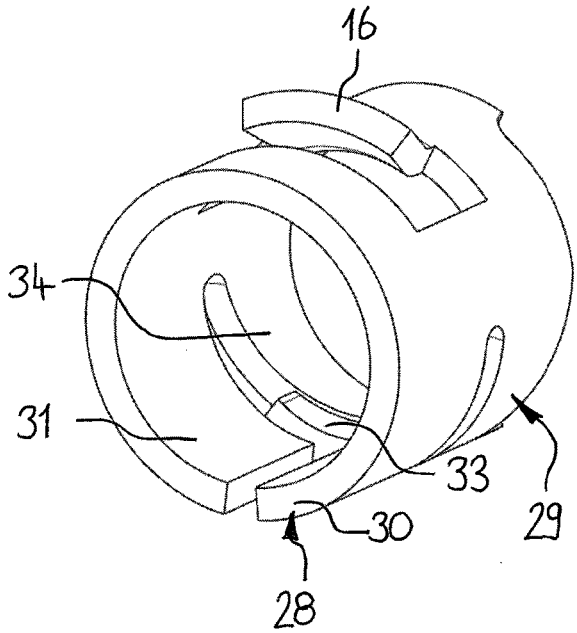
FIG. 6 is a perspective view of a ferrule of the electrical connector according to FIG. 1.
Figure 7:
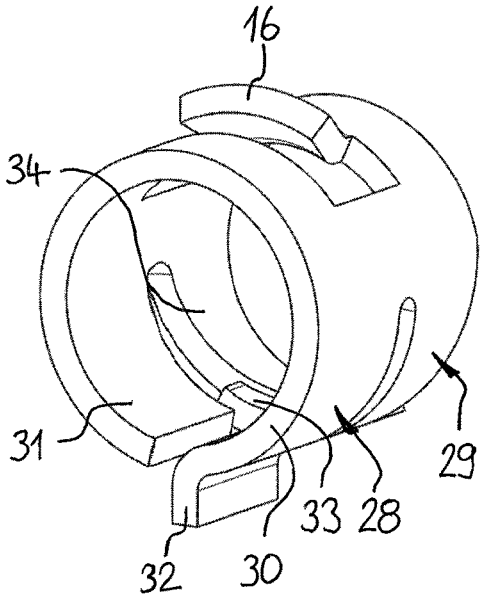
FIG. 7 is a perspective view of another embodiment of a ferrule.

Within the receptacle 11 the terminal body 1 has a guiding rib 25 extending parallel to the longitudinal axis L and projecting from the inner face of the terminal body 1 in a radial direction, as can be seen in FIG. 5. The guiding rib 25 also has an enlarged portion 27 having a greater extension in the circumferential direction than the rest of the guiding rib 25 so that the guiding rib 25 is adapted to the guiding slot 24 and is arranged within the guiding slot 24 in the mounted condition of the insulator 2 within the terminal body 1. The enlarged portion 27 of the guiding rib 25 forms said second stop face 19 so that in a fully inserted condition of the insulator 2 within the terminal body 1 the second front face 21 of the insulator 2 abuts the second stop face 19 of the guiding rib 25.

Hence, it is ensured that neither the insulator 2 nor the ferrule 3 can be inserted too deep into the terminal body 1 and have a definite position in the insertion direction M.

In order to ensure that the cable 9 cannot be pulled out of the terminal body 1 the ferrule 3 is provided with a lug 16 which projects from an outer circumferential face of the ferrule 3 in a radial direction and which projects into a locking opening 17 of the terminal body 1. In a direction opposite the insertion direction M the lug 16 is axially supported against a locking face 18 of the locking opening 17. The lug 16 is angled in regard to the longitudinal axis L such that during inserting the ferrule 3 into the cavity 11 the lug 16 is pushed radially inwardly until the lug 16 reaches the locking opening 17 and deflects back into a relaxed position in which the lug 16 projects into the locking opening 17.

Due to the fact that the insulator 2 is only connected to the single wires 8 of the cable 9 by way of the male terminals 6, the insulator 2 would be pushed towards the insulation 10 of the cable 9 when the electrical connector is mated with a counter connector so that the wires 8 would be bent or buckled. In order to avoid this, the terminal body 1 is provided with locking arms 22 which project into the receptacle 11 in a relaxed position. The locking arms 22 can be radially pushed outwardly when the insulator 2 is inserted into the receptacle and flip back into the relaxed position when the insulator 2 is in a fully inserted condition. In this fully inserted condition of the insulator 2 the locking arms 22 project behind second locking faces 23 of the insulator 2 so that the insulator 2 is supported in a direction opposite to the insertion direction M against the locking arms 22.

When the terminal body 1 is inserted into the connector housing 4 a wall portion 30 of the connector housing 4 avoids that the locking arms 22 can be pushed radially outwardly so that the locking arms are secured. Further, if the insulator 2 is not fully inserted into the terminal body 1 the locking arms 22 are pushed radially outwardly by the insulator 2 so that the locking arms 22 project over an outer circumferential face of the terminals body 1 and would collide with the wall of the connector housing 4 when trying to insert the terminal body 1 into the housing 4. This ensures that the terminal body 1 can only be inserted into the connector housing 4 then the insulator 2 is fully inserted into the receptacle 11.

The ferrule 3, which is shown in more detail in FIGS. 6 to 9, has a sleeve-like holding portion 28 and a crimp portion 29 which are arranged consecutively in axial direction of the longitudinal axis L. Viewed in the insertion direction M the crimp portion 29 is arranged in front of the holding portion 28. The outer diameter of the holding portion 28 is adapted to the inner diameter of the rearward portion 13 of the receptacle 12 so that the ferrule 3 is centered to the longitudinal axis L within the rearward portion 13 of the receptacle 11. The ferrule 3 is made of a sheet metal material and bent into the form as shown in the drawings. The holding portion 28 comprises two wall portions 30, 31 which are bent into the sleeve-like holding portion 28.

The holding portion 28 can be provided with a polarization rib 32 (FIG. 7) which projects from the holding portion 28 in a radial direction and is orientated in the longitudinal direction L so that the ferrule 3 can be inserted with its polarization rib 32 into a polarization slot of the terminal body 1. In the drawings only an embodiment of the ferrule 3 having a polarization rib (FIG. 7) is shown but not a terminal body having a polarization slot.

The crimp portion 29 has two crimp wings 33, 34. The crimp wings 33, 34 are bent such that the crimp portion 29 has a sleeve-like form. The crimp wings 33, 34 are wound around the insulation 10 of the cable 9 and overlap each other. This means, that the crimp wings 33, 34 are arranged one behind the other viewed in insertion direction M.

Figure 8:
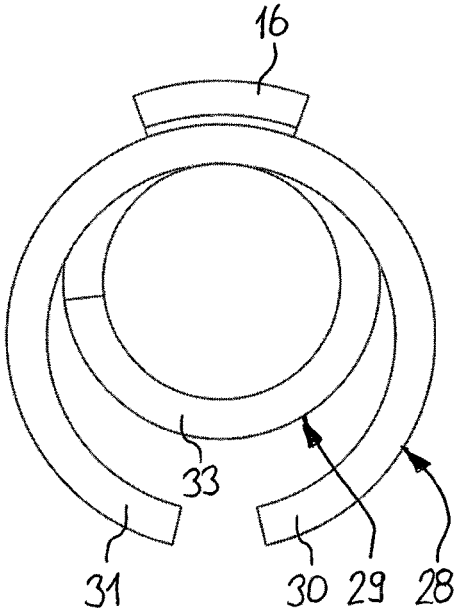
FIG. 8 is a front view of the ferrule according to FIG. 5 crimped to a cable having a small diameter.
Figure 9:
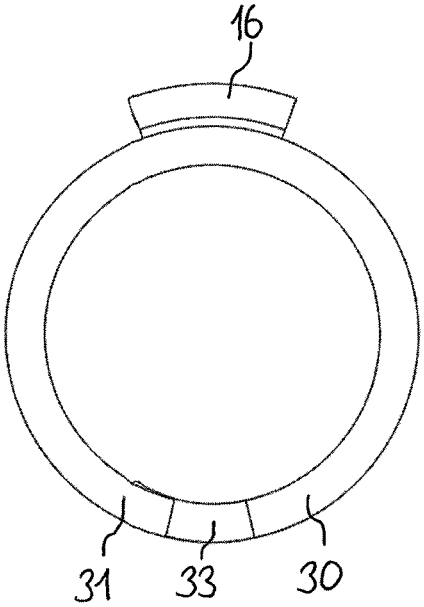
FIG. 9 is a front view of the ferrule according to FIG. 5 crimped on to a cable with a bigger diameter than in FIG. 8.

The overlapping of the crimp wings 33, 34 is important in order to ensure that the crimp portion 29 can be adapted to different cable diameters as shown in FIGS. 8 and 9. FIG. 8 shows the crimp portion 29 being crimped onto a cable having a smaller diameter than the cable as shown in FIG. 9. Therefore, the same ferrule 3 can be used for different cable diameters so that cables with different diameters can be connected to one and the same terminal body 1. As the holding portion 28 of the ferrule 3 centers the ferrule 3 within the rearward portion 13 of the receptacle 11 cables of different diameters can be connected with the terminal body 1.

Figure 10:
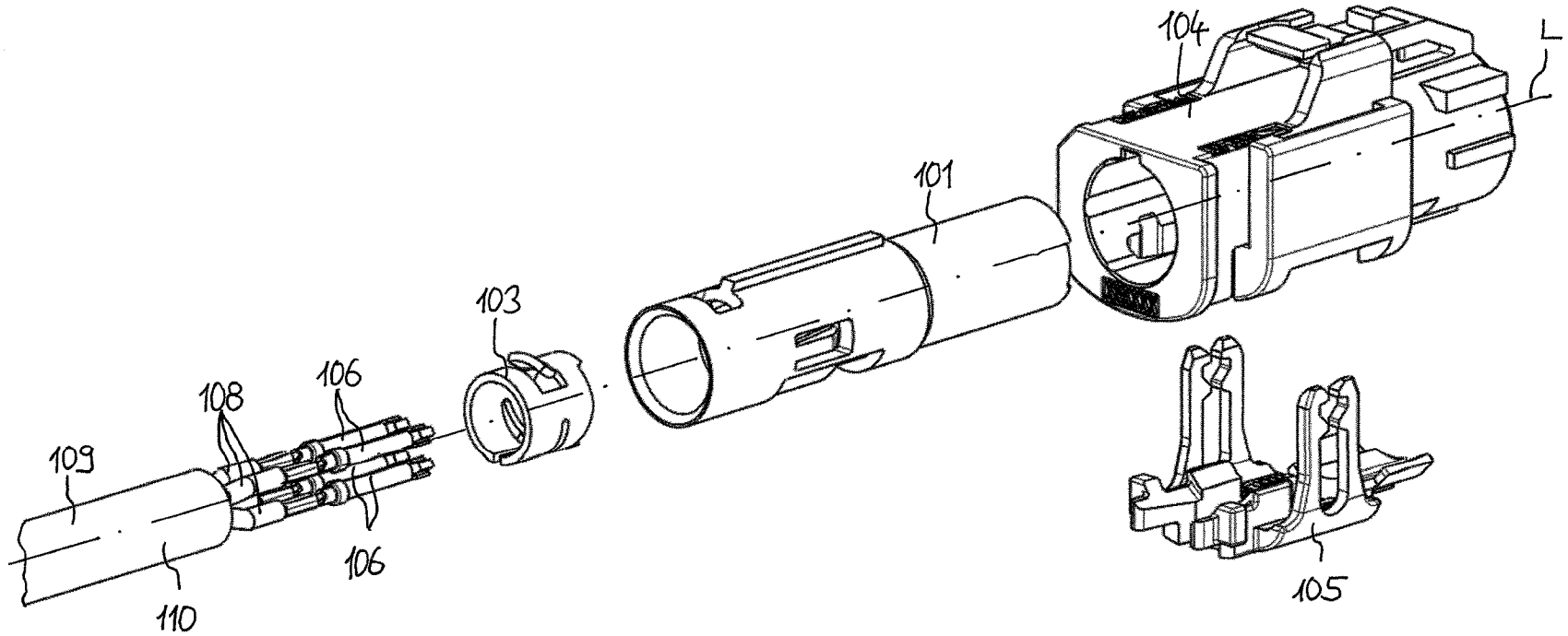
FIG. 10 is an exploded view of a second embodiment of an electrical connector.
Figure 11:
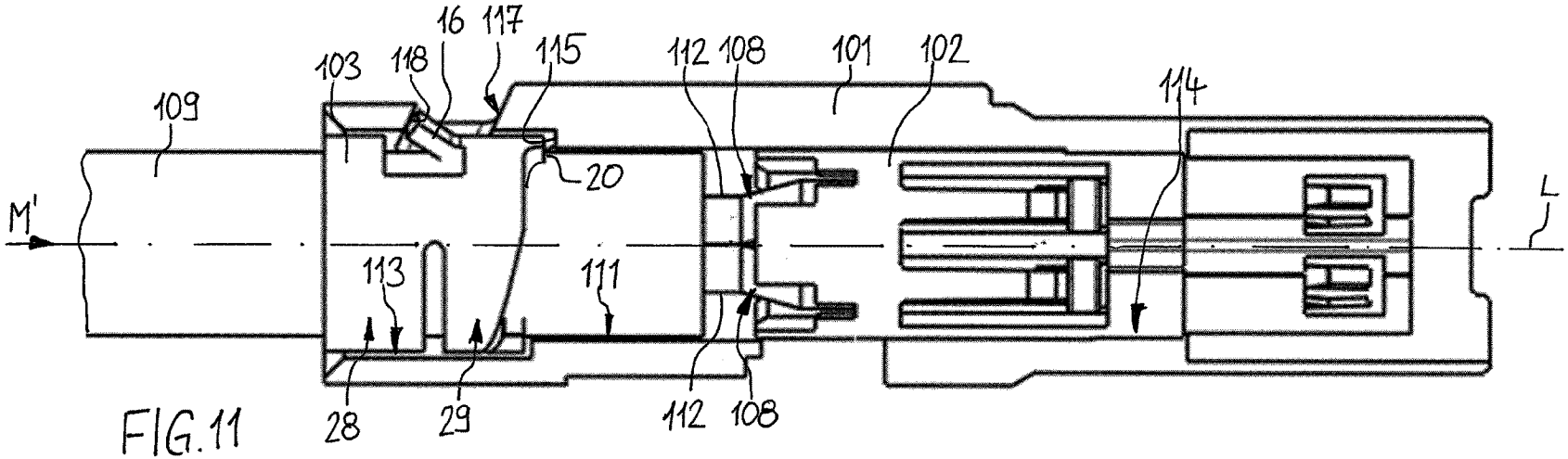
FIG. 11 is a first longitudinal sectional view of the electrical connector according to FIG. 9
Figure 12:
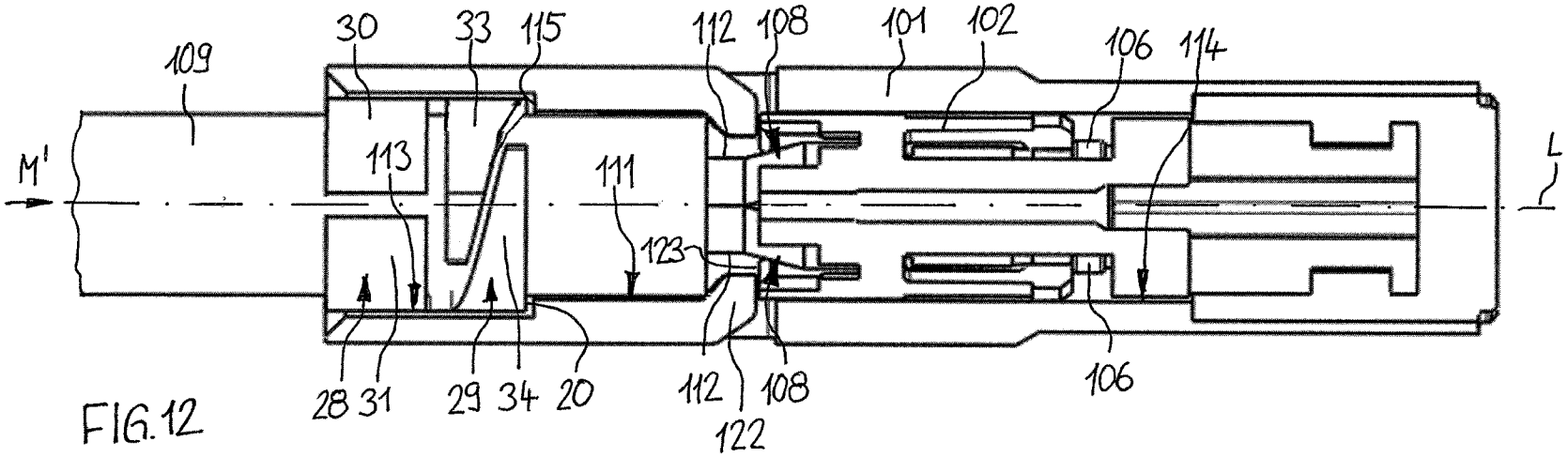
FIG. 12 is a second longitudinal sectional view of the electrical connector according to FIG. 9.

The ferrule 3 also can be used for electrical connectors having male terminals and having female terminals. FIGS. 10 to 12 show a counter connector as second embodiment of an electric connector having female terminals wherein the same ferrule 3 is used as in connection with the embodiment as disclosed in the FIGS. 1 to 9. In the FIGS. 10 to 12 all elements having the same function as in the first embodiment are provided with the same reference numerals increased by 100 and are described in connection with the first embodiment.

The invention claimed is:

1. An electrical connector comprising:

a terminal body;

an insulator accommodated within a receptacle of the terminal body, said insulator having at least one cavity adapted for holding a terminal connected to a wire of a cable; and a metal ferrule accommodated within said receptacle of said terminal body;

wherein said metal ferrule has a crimp portion adapted to be crimped onto said cable, wherein said metal ferrule is connected to said terminal body, and wherein said metal ferrule has a sleeve like holding portion centering the ferrule within the receptacle.

2. The electrical connector of claim 1, wherein the holding portion of the ferrule is formed by wall portions bent into the form of a sleeve.

3. The electrical connector of claim 1, wherein the holding portion and the crimp portion are arranged consecutively in axial direction.

4. The electrical connector of claim 1, wherein the holding portion is provided with a polarization rib projecting in a radial direction.

5. The electrical connector of claim 1, wherein the insulator is accommodated within a forward portion of the receptacle and wherein the ferrule is accommodated within a rearward portion of the receptacle.

6. The electrical connector of claim 1, wherein the insulator and the ferrule are inserted into the receptacle in an insertion direction parallel to a longitudinal axis of the terminal body.

7. The electrical connector of claim 6, wherein the ferrule is axially supported in insertion direction against a first stop face arranged in the forward portion of the receptacle.

8. The electrical connector of claim 6, wherein the insulator is axially supported in insertion direction against a second stop face arranged in the rearward portion of the receptacle.

9. The electrical connector of claim 6, wherein the terminal body is provided with at least one locking arm supporting the insulator against pull-out forces in a direction opposite to the insertion direction.

10. The electrical connector of claim 6, wherein the ferrule is provided with a locking projection supporting the ferrule against the terminal body in a direction opposite to the insertion direction.

11. The electrical connector of claim 10, wherein the locking projection projects from an outer circumferential surface of the ferrule in a radial direction.

12. The electrical connector of claim 1, wherein the ferrule is made of sheet metal bent into a substantial sleeve like form.

13. The electrical connector of claim 12, wherein the locking projection is a lug cut out of the sheet metal and bent radial outwardly.

14. The electrical connector of claim 1, wherein the crimp portion has crimp wings wound around the cable and overlapping each other.

15. The electrical connector of claim 1, wherein the metal ferrule is retained in an axial direction of the terminal body.

* * * * *